US006216993B1

(12) United States Patent
Morris

(10) Patent No.: US 6,216,993 B1
(45) Date of Patent: Apr. 17, 2001

(54) MODULAR STORAGE SYSTEM

(76) Inventor: Stephen A. Morris, 1348 W. Hempstead, Eagle, ID (US) 83616

( * ) Notice: Subject to any disclaimer, the term of this patent is extended or adjusted under 35 U.S.C. 154(b) by 0 days.

(21) Appl. No.: 08/938,207

(22) Filed: Sep. 26, 1997

(51) Int. Cl.[7] ..... A47H 1/16
(52) U.S. Cl. ..... 248/302; 248/295.11
(58) Field of Search ..... 248/302, 295.11, 248/207, 298.1, 327, 297.21, 244, 343, 223.41, 224.61; 211/94.01, 103, 162, 85.15; 312/245, 246; 220/476, 480, 481, 23.83

(56) References Cited

U.S. PATENT DOCUMENTS

| | | | | |
|---|---|---|---|---|
| 210,345 | | 11/1878 | Mayo et al. . | |
| 921,673 | | 5/1909 | Carnes . | |
| 2,427,335 | * | 9/1947 | Antonia et al. | 248/223.41 |
| 2,971,653 | * | 2/1961 | Shaw | 248/223.41 X |
| 3,092,302 | | 6/1963 | McDermott | 229/52 |
| 4,008,872 | * | 2/1977 | Thompson | 248/224.61 |
| 4,020,947 | | 5/1977 | Roccaforte | 206/45.31 |
| 4,273,394 | | 6/1981 | Chandler | 312/184 |
| 4,627,539 | | 12/1986 | Chang et al. | 206/597 |
| 4,697,776 | * | 10/1987 | Edson | 248/302 |
| 4,703,850 | | 11/1987 | Walker | 206/293 |
| 4,789,075 | | 12/1988 | Sun | 220/4 F |
| 4,991,723 | * | 2/1991 | Elkins | 248/295.11 |
| 5,000,124 | * | 3/1991 | Bergen | 248/295.11 |
| 5,123,549 | * | 6/1992 | Finses et al. | 211/103 X |
| 5,328,042 | | 7/1994 | Heise | 220/7 |
| 5,375,802 | * | 12/1994 | Branham, II | 211/94.01 X |
| 5,683,066 | * | 11/1997 | McCann | 248/295.11 |
| 5,775,521 | * | 7/1998 | Tisbo | 211/94.01 |

* cited by examiner

*Primary Examiner*—Anita M. King
(74) *Attorney, Agent, or Firm*—Robert L. Shaver; Frank J. Dykas

(57) ABSTRACT

A modular storage system which includes a support rail mounted on wall or ceiling, in horizontal or vertical orientation, with slidably adjustable cantilevered hooks, from which are hung storage boxes fitted with a frame on the open side, and a transparent hinged door. A hanger and straps are utilized to attach the rigid frame to a storage box. Reinforcing support brackets can also be attached to a storage box on its underside or top, and suspended from cantilevered hooks of the modular storage system.

7 Claims, 6 Drawing Sheets

MODULAR STORAGE SYSTEM

BACKGROUND OF THE INVENTION

1. Field of the Invention

The present invention relates to a modular storage system, and more particularly to a wall or ceiling mounted system for mounting storage boxes on a rail system.

2. Description of Related Art

It is an axiom of modern life that storage needs expand to equal and exceed the amount of storage space available. In the office and in the home, various systems have been developed over the years to store materials. Filing cabinets are utilized for papers which need to be frequently accessed, and storage drawers are similarly used. Store rooms, garages, file rooms and document rooms are also equipped with shelves on which cardboard boxes are placed, with stored material inside the cardboard boxes. When the shelves are full, or until they are built, a common method of storage is to put materials to be stored in cardboard boxes, and stack the cardboard boxes in stacks. This has the advantage of being cheap and easy to do, but has the disadvantage that you may have to unstack the entire stack of boxes to find objects which are located in the bottom box. If you don't have a record of what is in each box, you may have to open each box searching for the material to be retrieved from storage.

Bookshelves also have the disadvantage that whether they are filled with boxes or totally empty, the bookshelves occupy an entire area, such as a wall, and essentially prevents that wall from being used for anything else.

What is needed is a storage system which mounts easily to an unused space, such as a wall or a ceiling, but when not in use allows that space to be utilized for other purposes. What is also needed is a storage system which is modular, so that storage boxes may be opened and inspected without having to unstack a vertical stack of boxes. Such a modular system also has to be adjustable, to account for various sizes of boxes. What is also needed is a way to determine the contents of a particular box without having to open the lid of that box or unstack a stack of boxes. It would also be desirable to be able to view the contents of a box or open a particular storage box by accessing the side of a box facing the user, rather than having to open the flaps on the top or removing a lid from the top of the box.

Accordingly, it is an object of the invention to provide a storage system which mounts to an unused space, such as a wall or a ceiling. It is also an object of this invention that the storage system be modular and provide storage boxes which are not stacked upon each other, but may be individually viewed and opened to remove stored contents. It is a further object of the invention to provide a modular storage system which is adjustable, so that boxes of various sizes may be utilized and when not necessary, storage boxes may be removed from the system. It is a further object of the invention to provide a modular storage box which allows the contents of a particular box to be viewed, and for the box to be opened and the contents removed or added to without having to unstack other boxes.

Additional objects, advantages and novel features of the invention will be set forth in part in the description as follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects and advantages are obtained by a modular storage system which includes one or more storage containers or boxes, a support rail, and a means of attaching storage boxes to the support rails. The support rails are attached to a wall or ceiling. One way of attaching the storage boxes to a support rail is by the use of one or more cantilevered hooks. These hooks are inserted into a recess in the support rail, and when pressure is applied at one end of a hook, the other end of the hook locks in place inside the support rail. The support rail can be oriented either horizontally or vertically on a wall, or horizontally on a ceiling, with its attached storage boxes which form an array of storage boxes. In one version of this invention, the storage boxes are used with a rigid frame which is mounted on the edges of the storage box. A door can be utilized which fits in the rigid frame which is removable and openable. Being able to open the door, or see through the door if it is transparent, allows easy identification of the contents of the storage box, and easy access to the contents. The rigid frame would typically be mounted onto the storage box by a strap which attaches to one edge of the rigid frame, wraps around three sides of the box, and attaches to a side of the rigid frame opposite the side to which the strap was first attached. Mounted integrally with this strap is a top edge bracket assembly. The top edge bracket assembly is basically an L-shaped bracket which mounts on the top of the rear edge of the storage box and attaches to the strap. The strap can be configured to be two straps, each of which attach to an edge of the top edge bracket assembly. The top edge bracket assembly has a hanging loop by which the storage box is attached to one of the cantilevered hooks. The top edge bracket assembly also has a rail guide which is used for orienting the top edge bracket and therefore the storage box to the support rail.

The modular storage system described above can also include one or more rigid support sections which can be mounted on the under side of the storage box for providing additional strength and rigidity to the storage box. This allows the storage box, by use of the rigid support sections, to support a heavier weight without deforming. Optionally, several rigid support sections could be mounted on the under side of a storage box by the use of flexible straps. One or more rigid support sections could also be mounted on the top side of the storage box, and could be linked with the rigid support sections on the under side of the storage box by a loop of flexible strap material. Such strap material could also have a closure, buckle or other means of adjusting and securing the flexible strap. The rigid support sections could consist of two pieces which telescope one into the other and are adjustable for length.

In another version of the modular storage system, rather than providing support to the storage box by the attachment of a top edge bracket assembly, and using the hanging loop from the top edge bracket assembly to attach to a cantilevered hook, another method of attachment is also possible. A top suspension handle can be utilized which is a generally U-shaped handle which attaches to the top of the storage box by a strap which encircles the storage box and secures the storage box to the top suspension handle. One or more rigid support sections can be utilized with this embodiment of the invention, either mounted below or above the storage box, as previously described.

Still other objects advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawing and description are to be regarded as illustrative in nature, and not as restrictive.

DESCRIPTION OF THE PREFERRED EMBODIMENTS

Figure 1:
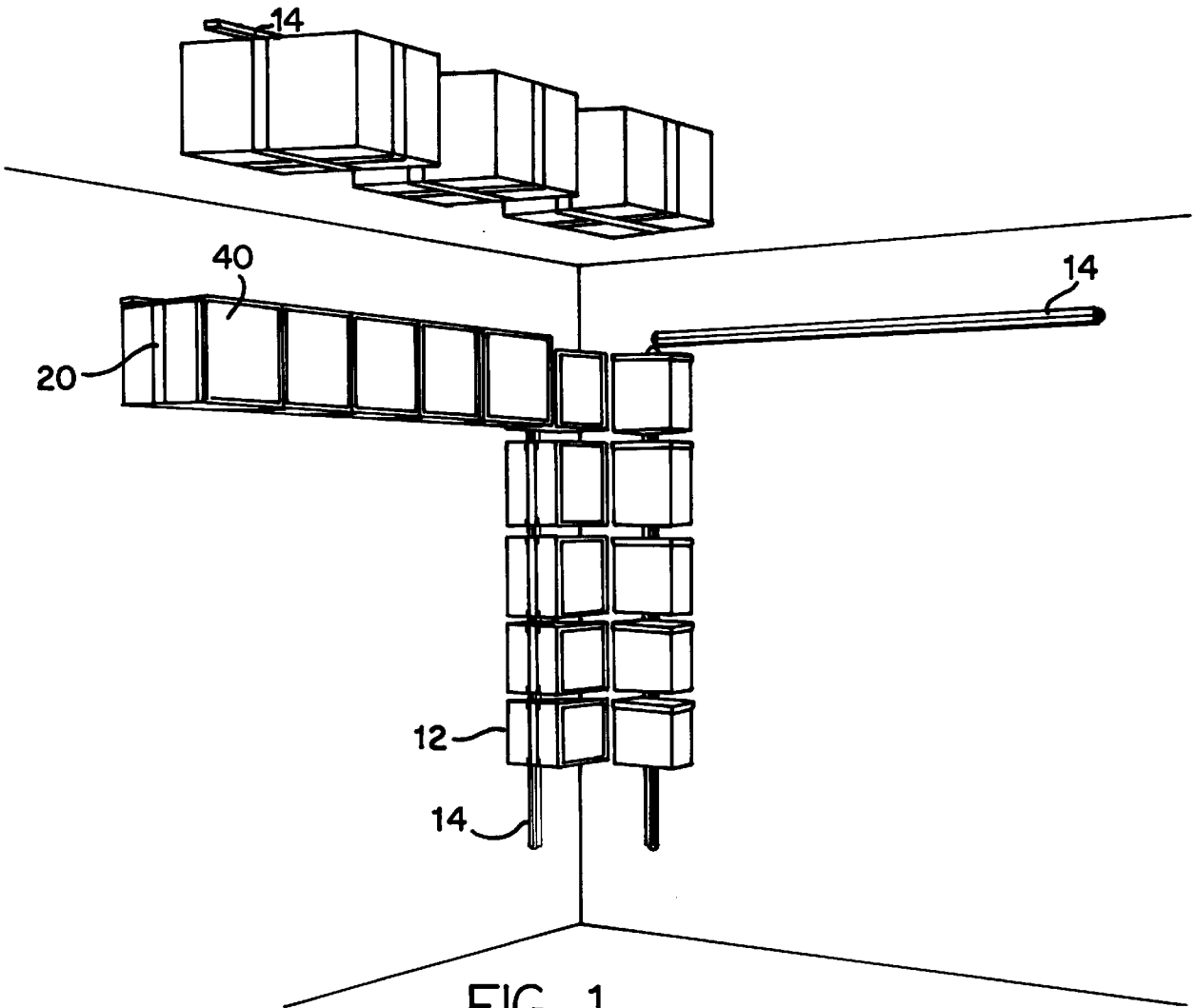
FIG. 1 is a perspective drawing of the modular storage system.

The preferred embodiments of the invention are shown in the figures. FIG. 1 is a perspective view of an array of storage boxes, oriented horizontally and vertically on a wall, and horizontally on the ceiling. The best mode of the invention includes a support rail 14, shown in detail in FIG. 3 and in cross-section in FIG. 4. The support rail is a generally four sided linear structure made of a metal, such as steel, or a durable plastic. One side of the support rail 14 is a rail back 44. Connected at right angles to the edges of the rail back 44, is first rail side 76 and opposite is second rail side 78. Attached along an edge of first rail side 76 and perpendicular to it is first side rail 50. Attached to one edge of second rail side 78 and perpendicular to it is second side rail 48. The gap between first side rail 50 and second side rail 48 forms an inter-rail slot 52 through which cantilevered hooks 28 are inserted. Rail back 44 also includes several mounting holes 46 through which nails, screws or bolts can be used to mount the support rail 14 to a wall or ceiling. In the best mode, support rail 14 is made of steel and is approximately six to eight feet in length, three-quarters of an inch wide, with a depth of an inch to one-half inch. The support rail 14 also includes rail steps 62, as shown in FIG. 4, which are provided along rail back 44 and which interact with cantilevered hook 28 to provide a positive positioning mechanism for cantilevered hook 28.

Figure 2:
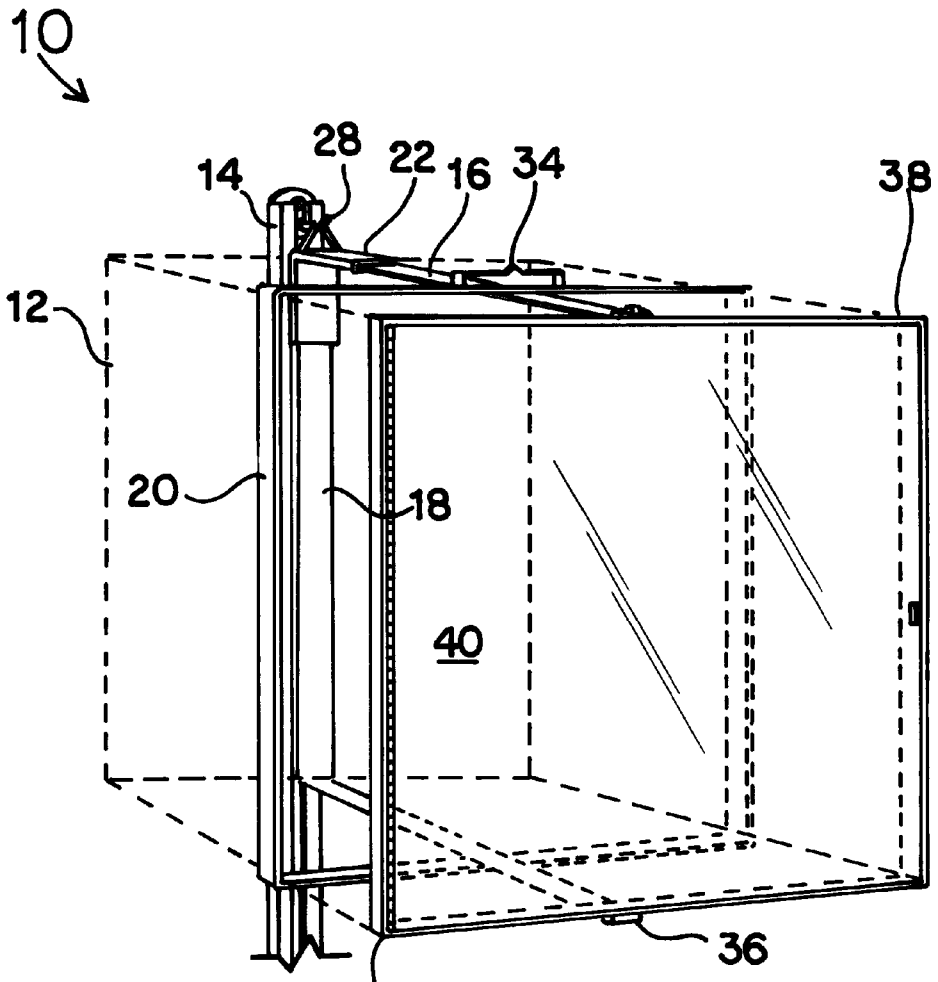
FIG. 2 is a perspective drawing of a storage box.
Figure 2A:
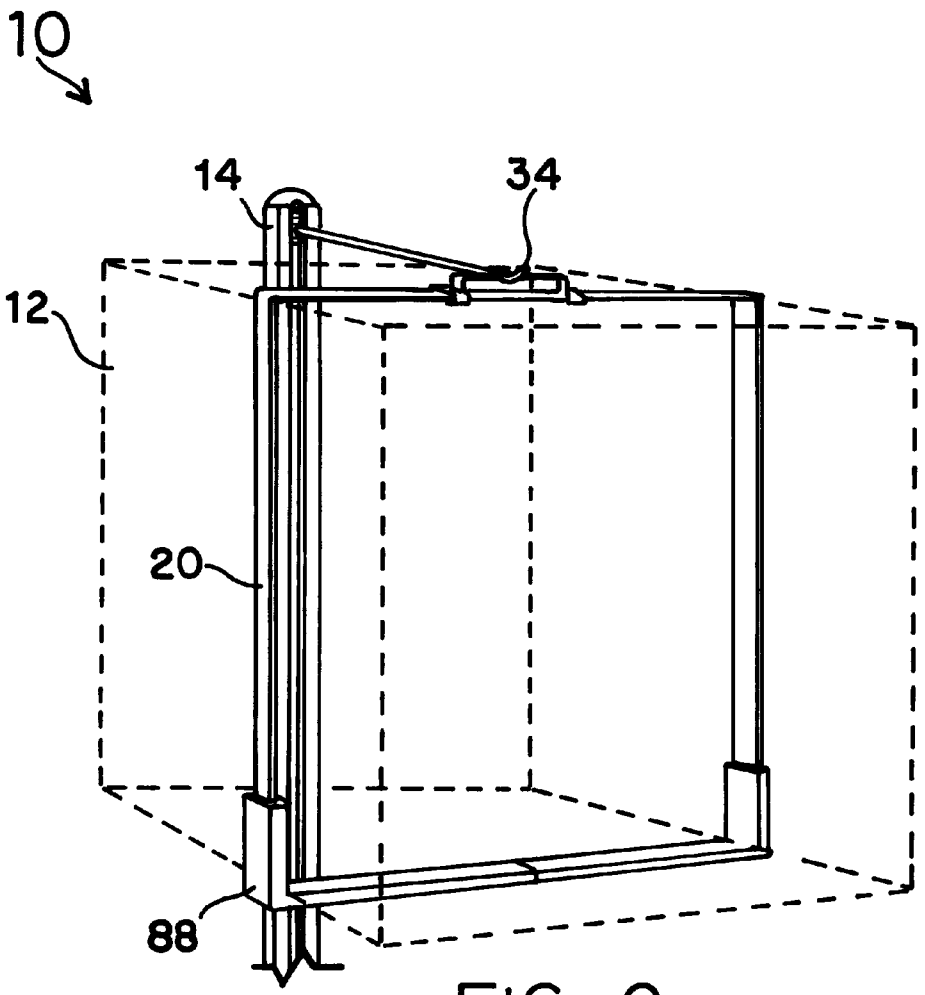
FIG. 2A is a perspective drawing of a storage box with a support bracket.

The modular storage system 10 also includes storage containers or boxes 12, as shown in FIGS. 1, 2 and 2A. These storage boxes are specially made for use with the modular storage system 10, and are produced in small, medium and large sizes. The front of each box is open ended.

The modular storage system 10 also includes a rigid frame 38, as shown in FIG. 2. The rigid frame 38 may optionally contain a door 40, which is attached by hinges 42. Preferably the rigid frame 38 is made of plastic, although metal would also work. Preferably the door 40 is of transparent plastic. The rigid frame 38 is attached to the open side of the storage box 12 and adds rigidity to the storage box 12, as well as providing a means of seeing the stored material in the storage box 12, and providing easy access through the door 40.

Figure 3:
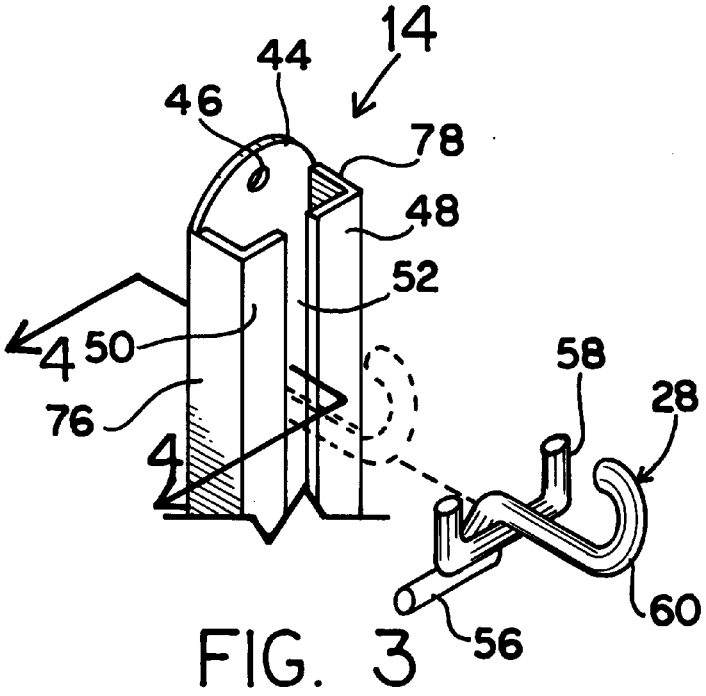
FIG. 3 is a perspective drawing showing the support rail and a cantilevered hook.
Figure 4:
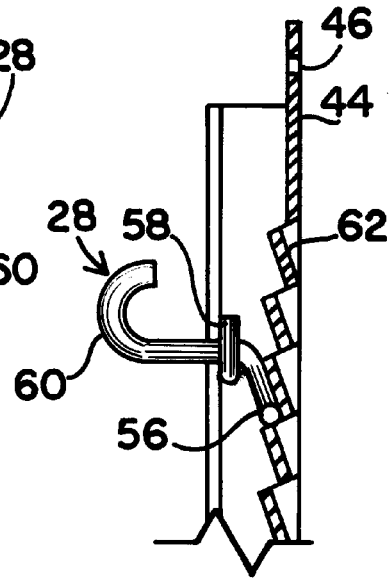
Fig. 4 is a cross-sectional drawing of a support rail and a cantilevered hook.
Figure 5:
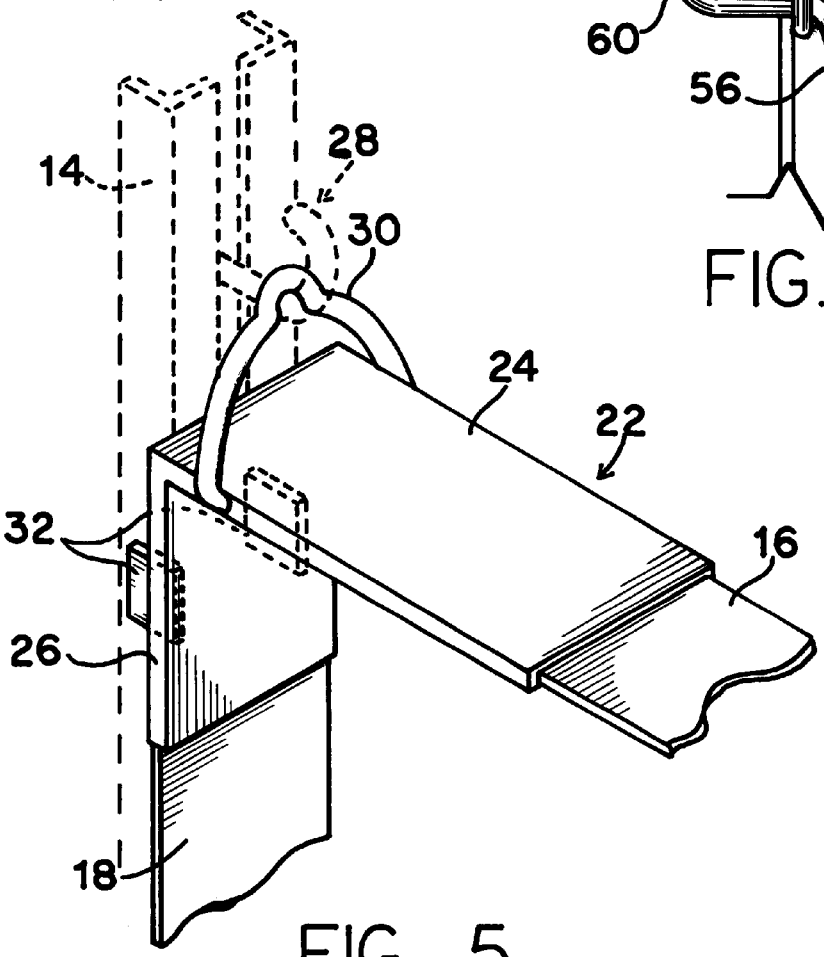
FIG. 5 is a perspective drawing of a top edge bracket.

Another component of the modular storage system 10 is a cantilevered hook 28, as shown in FIGS. 3 and 4. Cantilevered hook 28 includes a hook base 56 and hook shoulder 58, and a hook finger 60. Cantilevered hook 28 is preferably made of a metal such as steel, but other material such as a durable plastic could also be utilized.

Another component of the preferred embodiment of modular storage system 10, is a top edge bracket 22 which is shown in FIG. 4. Top edge bracket 22 is formed of a top rectangular piece 24 and a back rectangular piece 26, which are joined along one of their edges. Attached to top rectangular piece 24 is a hanging loop 30. Attached to back rectangular piece 26 are rail guides 32.

Figure 6:
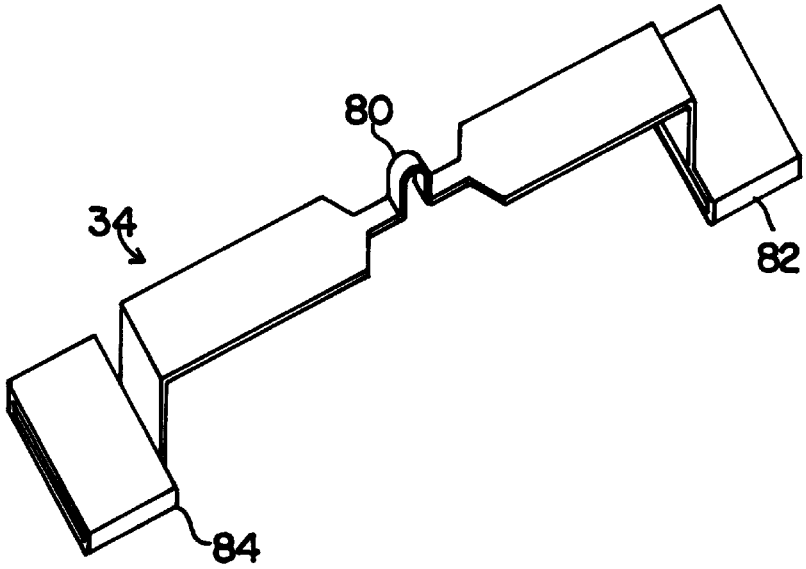
FIG. 6 is a perspective drawing of a top suspension handle.
Figure 7:
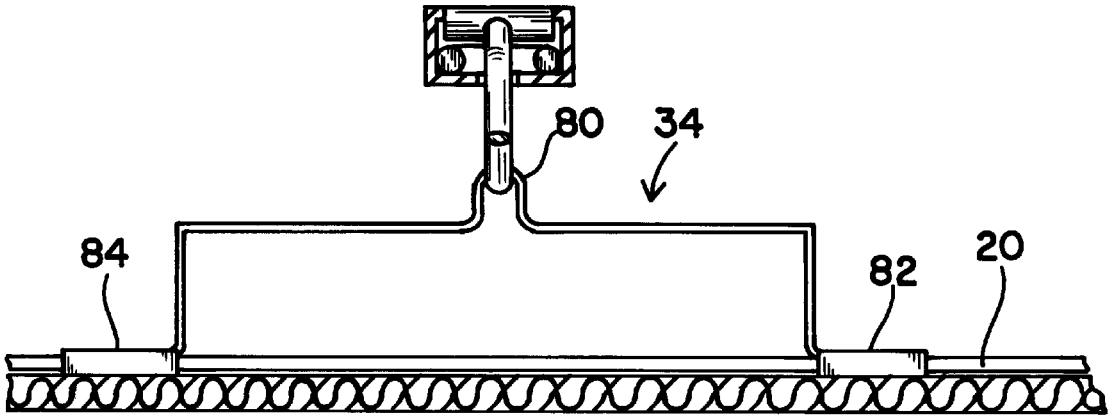
FIG. 7 is a side cross-sectional view of a top suspension handle mounted on a storage box and suspended from a cantilevered hook.

Another component of the preferred embodiment of the modular storage system 10, is a top suspension handle 34 as shown in FIGS. 6 and 7. This is a generally U-shaped piece of metal preferably, although a durable plastic could also be utilized. The top suspension handle 34 includes a hook loop 80 and strap guides 82 and 84. A strap 20 is utilized with the top suspension handle 34.

An optional further component is a support bracket 88 which can be utilized with the top suspension handle 24 and strap 20, or with a strap 20 by itself optionally, one or more support brackets 88 can be mounted below the storage box 12 or above storage box 12.

A second preferred embodiment of the modular storage system 10 is shown in FIG. 2A. In this embodiment, a non standardized size storage box 12 is utilized. As shown in FIG. 2A, a top suspension handle 34 is mounted on the top and utilizes a strap 20 which encircles the storage box 12. In addition to the top suspension handle 34 and the strap 20, a support bracket 88 may be mounted on the underside of the storage box 12 to provide additional rigidity for heavy loads. One or more support brackets 88 can be mounted on the underside of the box, and if necessary one or more can be mounted on top of the box to give further rigidity to the storage box 12. The support bracket 88 is preferably made of two pieces, one of which adjustably telescopes into the other, and can be adjusted for the dimensions of a particular box.

In use, the modular support system is assembled by mounting support rail 14 to a wall or ceiling, by nails or screws. Next, cantilevered hooks 28 are inserted into the support rail 14 through the inter-rail slot 52. Top edge bracket 22 is mounted to a small, medium or large box in the center of its top rear edge. First strap 16 is extended across the top of storage box 12 and strap hook 36 is attached to the edge of rigid frame 38. Rigid frame 38 is mounted so that the four edges of rigid frame 38 fit over the four edges of the open side of storage box 12. Second strap 18 extends from top edge bracket 22 down the back of storage box 12, along its underside, and attaches with a second strap hook 36 to rigid frame 38. First strap 16 and second strap 18 are adjusted to securely attach straps, the top edge bracket, and rigid frame 38 to the storage box 12. Optionally, a top suspension handle 34 can be mounted to the top of a storage box 12, using a strap 20. With one or both of the top edge bracket 22 and the top suspension bracket 34 mounted to the storage box 12, the storage box 12 may be hung by the hanging loop 30 of the top edge bracket from the cantilevered hook 28. The cantilevered hook 28 can be moved up and down in the support rail 14, so that hook base 56 interacts with rail step 62 to lock the cantilevered hook 28 into the preferred position.

Figure 8:
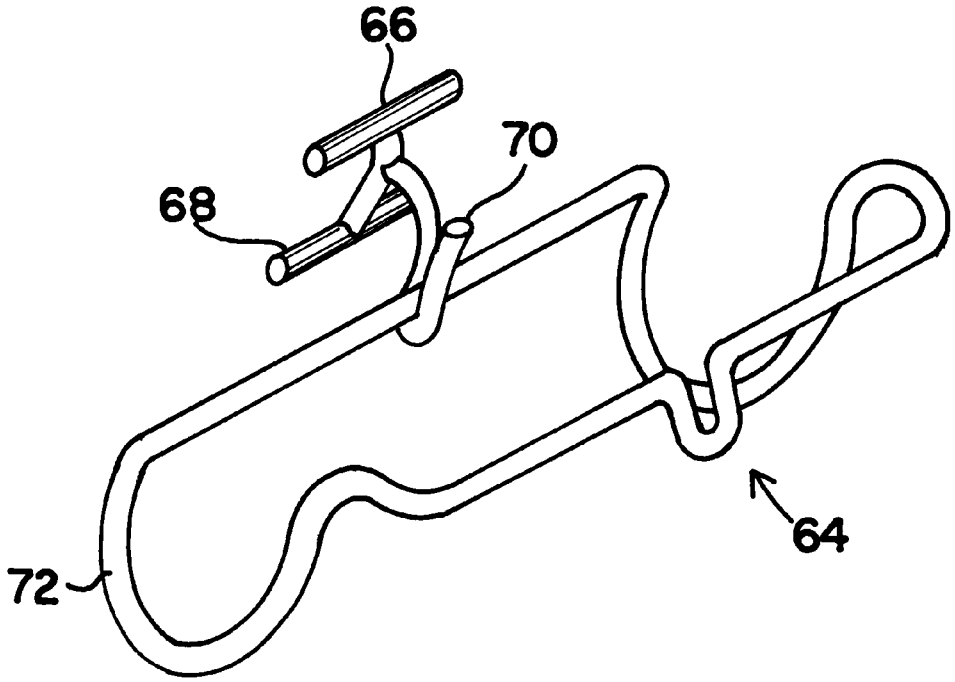
FIG. 8 is a perspective view of a cantilevered hook configured to support a plastic tote.
Figure 9:
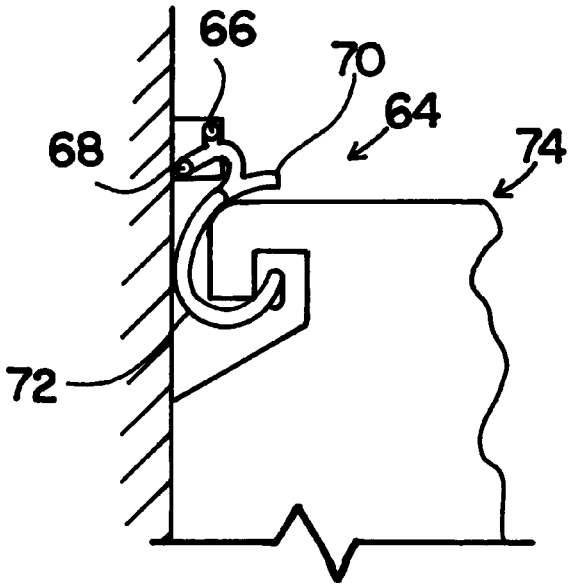
FIG. 9 is a side view of a plastic tote suspended from a cantilevered hook configured to support plastic totes.

A third preferred embodiment is shown in FIGS. 8 and 9. This embodiment includes a modification of cantilevered hook 28. This version of cantilevered hook 28 is called a tote hook 64, and includes a tote hook handle grip 72, a tote hook base 68, a tote hook shoulder 66, and a tote hook keeper 70. These interact with a commercially available rubber or plastic storage container, termed a tote 74. FIG. 8 shows a perspective view of the tote hook 64, and FIG. 9 shows a side view of tote hook 64 supporting a plastic tote 74.

While there is shown and described the present preferred embodiment of the invention, it is to be distinctly understood that this invention is not limited thereto but may be variously embodied to practice within the scope of the following claims.

I claim:

1. A modular storage system comprising;

one or more storage containers which form an array of storage containers for storing items, and which include four or more edges;

one or more cantilevered hooks for attaching to a support rail and for supporting said one or more storage containers;

a rigid frame with a top and bottom and left and right edges, which mounts on four edges of said one or more storage containers, for providing rigidity to said one or more storage containers, for supporting a door, and for attachment by straps to a top edge bracket and a top suspension handle;

a transparent door which fits in said rigid frame which is removable or openable, and which allows easy access to contents of said one or more storage containers;

a top edge bracket assembly for attachment to an edge of said rigid frame, formed of a top rectangular piece and a back rectangular piece joined along an edge normal to each other, a hanging loop attached to one of said rectangular pieces, a rail guide for orienting said top edge bracket assembly to said support rail, a first strap which attaches to said top rectangular piece and said top edge of said rigid frame, a second strap which attaches to said back rectangular piece and bottom edge of said one or more storage containers;

a top suspension handle for attachment to a top side of said one or more storage containers and for lifting of said container, formed of a suspension loop for lifting and for hanging from one of said one or more cantilevered hooks, a strap which attaches to said suspension loop and which encircles said one or more storage containers, and a means of securing and adjusting said strap;

one or more support rails for supporting a horizontally or vertically oriented array of said one or more storage containers, attached to a wall or ceiling, for supporting said one or more storage containers by use of said cantilevered hooks.

2. The modular storage system of claim 1 in which said cantilevered hooks are slidably adjustable.

3. The modular storage system of claim 1 in which the strap comprises one or more rigid support sections with a flexible strap portion and a means of securing said flexible strap portion.

4. The modular storage system of claim 3 in which said support sections comprise adjustably telescoping sections.

5. A modular storage system comprising:

one or more plastic storage containers with lifting handles for storing items, in which each of said one or more plastic storage container is openable without moving said one or more plastic storage container or an adjacent one or more plastic storage containers;

a means of attachment of said one or more plastic storage containers to a support rail, comprising:

a. one or more slidably adjustable cantilevered hooks;

b. a top edge bracket assembly for attachment to an edge of said one or more plastic storage container, formed of a top rectangular piece and a back rectangular piece joined along an edge normal to each other;

c. a hanging loop attached to one of said rectangular pieces;

d. a rail guide for orienting said top edge bracket assembly to said support rail;

e. one or more straps which attach to two edges of a rigid frame and which attaches to said top edge bracket assembly;

f. a top suspension handle for attachment to a top side of said one or more plastic storage container and for lifting of said one or more plastic storage container, formed of a suspension loop for lifting and for hanging from said means of attachment, a strap which attaches to said suspension loop and which encircles said one or more plastic storage container, and a means of securing and adjusting said strap; and one or more support rails, attached to a wall or ceiling, for supporting said one or more plastic storage containers by use of said means of attachment;

said rigid frame being mountable on four edges of said one or more plastic storage containers, said rigid frame having a hingedly attached transparent door which is removable or openable, and which allows easy access and viewing of contents of said one or more plastic storage containers;

one or more rigid support brackets comprising two piece adjustably telescoping sections, for mounting on said storage containers with a flexible strap portion and a means of securing said flexible strap portion to a means of attachment.

6. A modular storage system comprising:

one or more storage containers for storing items, in which said one or more storage containers are openable without moving said one or more storage containers or any other of said one or more storage containers, and in which said one or more storage containers are generally rectangular in shape, and include lifting handles;

one or more slidably adjustable cantilevered hooks, which connect to one or more slotted support rails, and which slide in said slotted rail to a selected position when lifted upward, and which lock in position when pressed downward by the weight of said one or more storage container, and which attach to and support said one or more storage container in a hanging position;

in which said one or more slotted support rails comprise a lateral and a longitudinal axis, and a length and width, and include a slot which extends the length of said slotted support rail, parallel with said longitudinal axis, and which are attachable to either a wall or a ceiling, for supporting said one or more storage containers by use of said hooks which connect to said rails;

a top edge bracket assembly for attachment to an edge of said one or more storage container, formed of a top and a back rectangular piece joined along an edge normal to each other, a hanging loop attached to one of said rectangular pieces, a rail guide for orienting said top edge bracket assembly to said support rail, and one or more straps which attach to two edges of a rigid frame and which attaches to said top edge bracket assembly;

said rigid frame being mountable on four edges of said one or more storage containers; and a transparent door which fits in or is hinged to said rigid frame, in which said door is removable or openable, and which allows a user to view contents of said one or more storage container and easy access to contents of said one or more storage container.

7. A modular storage system comprising:

one or more storage containers for storing items, in which said one or more storage containers are openable without moving said one or more storage container or any other of said one or more storage containers, and in which said one or more storage containers are generally rectangular in shape, and include lifting handles;

one or more slidably adjustable cantilevered hooks, which connect to one or more slotted support rails, and which slide in said one or more slotted support rail to a selected position when lifted upward, and which lock in position when pressed downward by the weight of said one or more storage containers, and which attach to and support said one or more storage containers in a hanging position;

in which said one or more slotted support rails comprise a lateral and a longitudinal axis, and a length and width, and include a slot which extends the length of said rail, parallel with said longitudinal axis, and which are attachable to either a wall or a ceiling, for supporting said one or more storage containers by use of said hooks which connect to said rails; and a top suspension handle for attachment to a top side of said one or more storage containers and for lifting of said one or more storage containers, formed of a suspension loop for lifting and for hanging from a means of attachment, a strap which attaches to said suspension loop and which encircles said storage container, and a means of securing and adjusting said strap; and one or more two piece adjustably telescoping rigid support brackets for mounting on said one or more storage containers, with a flexible strap portion and a means of securing said flexible strap portion to a means of attachment.

* * * * *